US005100025A

United States Patent [19]

McGraw

[11] Patent Number: 5,100,025

[45] Date of Patent: Mar. 31, 1992

[54] PUMP DISPENSING APPARATUS

[76] Inventor: Kim A. McGraw, 11661 Stoneview La. #11C, Reston, Va. 22091

[21] Appl. No.: 663,687

[22] Filed: Mar. 4, 1991

[51] Int. Cl.[5] ..... B65D 35/28; B65D 35/56; B67D 5/06; B67D 5/38

[52] U.S. Cl. ..... 222/95; 222/103; 222/105; 222/156; 222/181; 222/183; 222/336; 222/386

[58] Field of Search ..... 222/95, 103, 105, 156, 222/181, 185, 386, 386.5, 391, 183, 336, 340

[56] References Cited

U.S. PATENT DOCUMENTS

| | | | |
|---|---|---|---|
| Re. 26,488 | 11/1968 | Bull | 222/386.5 X |
| 972,793 | 10/1910 | Allred | 222/391 |
| 1,015,395 | 1/1912 | Newton | 222/391 |
| 1,387,356 | 8/1921 | Cook | 222/95 X |
| 2,282,727 | 5/1942 | Kasuske | 222/391 |
| 2,613,853 | 10/1952 | Halvorsen | 222/103 |
| 3,809,297 | 5/1974 | Poulten | 222/386 X |
| 4,323,176 | 4/1982 | Sartain | 222/391 X |
| 4,739,903 | 4/1988 | Bedwell et al. | 222/105 X |
| 4,793,521 | 12/1988 | Steiner | 222/156 |
| 4,898,304 | 2/1990 | Bacon, Jr. | 222/105 X |

*Primary Examiner*—Kevin P. Shaver
*Attorney, Agent, or Firm*—Leon Gilden

[57] ABSTRACT

An apparatus including a rigid housing mounting a lid containing a flexible, polymeric component containing bag therewithin, with the bag including a spout directed through an opening in the container, with the lid including a piston including an apex positioned medially thereof impinging upon an upper portion of the bag to effect expressing of contents of the bag through its nozzle when the piston is projected into the bag by a handle and piston rod mounted exteriorly of the bag. Bracket structure is provided to provide stability in mounting of the container to a vertical wall surface.

4 Claims, 5 Drawing Sheets

PRIOR ART

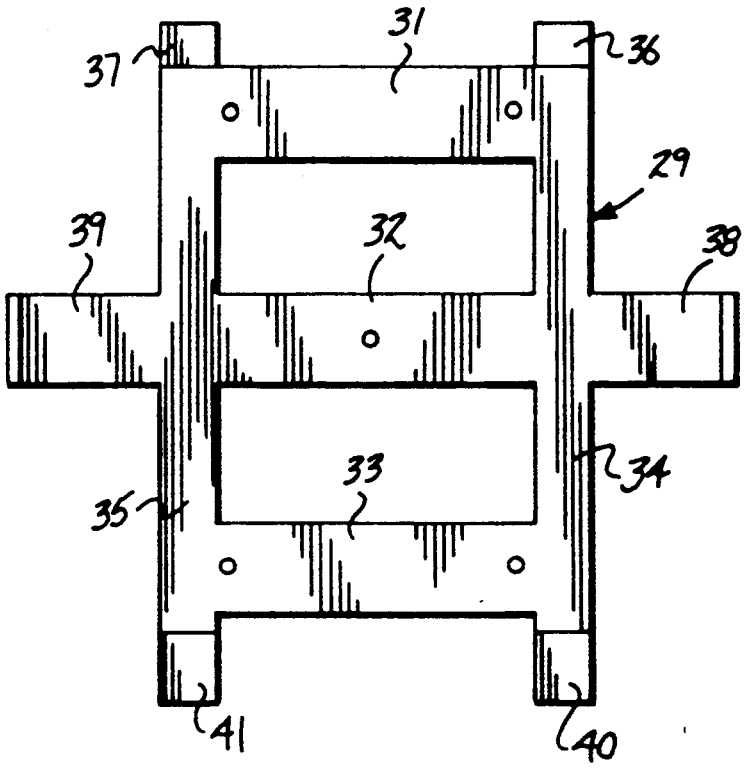
Fig 10
Fig 11
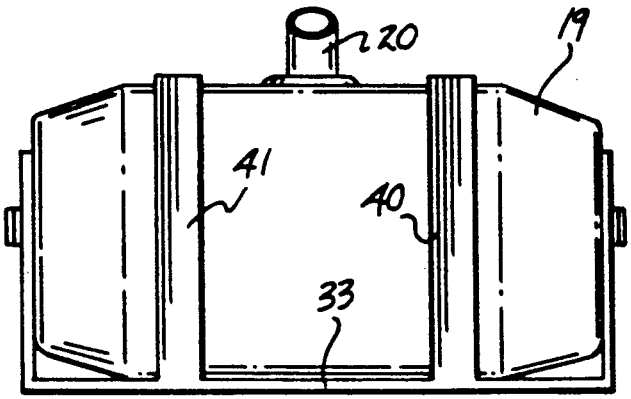

PUMP DISPENSING APPARATUS

BACKGROUND OF THE INVENTION

1. Field of the Invention

The field of invention relates to dispensing apparatus, and more particularly pertains to a new and improved pump dispensing apparatus wherein the same mounts a rigid container to a vertical wall surface in cooperation with a piston arranged to apply pressure to the flexible bag and direct contents exteriorly of the container.

2. Description of the Prior Art

Various dispensing apparatus is utilized in the prior art in cooperation with a flexible bag to permit storage of components in the flexible bag prior to expressing components from the bag structure exteriorly thereof as required. Examples of such prior art include U.S. Pat. No. 4,765,512 to Bull, Jr. wherein a spring construction in association with a polymeric film bag effects squeezing of contents from interiorly of the bag.

U.S. Pat. No. 4,627,551 to Kopt sets forth a dispenser system wherein a polymeric bag is directed through spaced rollers to effect pressurizing of contents within the bag to effect its expressing from the bag as required.

U.S. Pat. No. 4,776,488 to Gurzan utilizes a further example of a flexible bag and a valving arrangement for directing components from the bag as required.

U.S. Pat. No. 4,671,428 to Spatz utilizes a pump chamber to effect pressurizing of bag contents with a housing to effect flow from the bag contents.

U.S. Pat. No. 4,915,261 to Strenger provides for a beverage dispensing organization utilizing pressurizing systems for effecting flow of material from the chamber of the organization.

As such, it may be appreciated that there continues to be a need for a new and improved pump dispensing apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dispensing apparatus now present in the prior art, the present invention provides a pump dispensing apparatus wherein the same mounts fixedly to a vertical wall surface of a rigid container to permit selective expressing of components from a flexible bag container within the housing of the container. As such, the general purpose of the present invention, which will be described subsequently in greater detail, is to provide a new and improved pump dispensing apparatus which has all the advantages of the prior art dispensing apparatus and none of the disadvantages.

To attain this, the present invention provides an apparatus including a rigid housing mounting a lid containing a flexible, polymeric component containing bag therewithin, with the bag including a spout directed through an opening in the container, with the lid including a piston including an apex positioned medially thereof impinging upon an upper portion of the bag to effect expressing of contents of the bag through its nozzle when the piston is projected into the bag by a handle and piston rod mounted exteriorly of the bag. Bracket structure is provided to provide stability in mounting of the container to a vertical wall surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pump dispensing apparatus which has all the advantages of the prior art dispensing apparatus and none of the disadvantages.

It is another object of the present invention to provide a new and improved pump dispensing apparatus which may be easily and efficiently manufactured and marketed.

It is a further object of the present invention to provide a new and improved pump dispensing apparatus which is of a durable and reliable construction.

An even further object of the present invention is to provide a new and improved pump dispensing apparatus which is susceptible of a low cost of manufacture with regard to both materials and labor, and which accordingly is then susceptible of low prices of sale to the consuming public, thereby making such pump dispensing apparatus economically available to the buying public.

Still yet another object of the present invention is to provide a new and improved pump dispensing apparatus which provides in the apparatuses and methods of the prior art some of the advantages thereof, while simultaneously overcoming some of the disadvantages normally associated therewith.

Still another object of the present invention is to provide a new and improved pump dispensing apparatus wherein the same permits selective expressing of product from within a flexible container positioned within a rigid housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is an orthographic view, taken in elevation, of the mounting bracket utilized by the instant invention.

FIG. 11 is an orthographic bottom view of the mounting bracket in cooperation with the housing container of the instant invention.

DESCRIPTION OF THE PREFERRED EMBODIMENT

Figure 1:
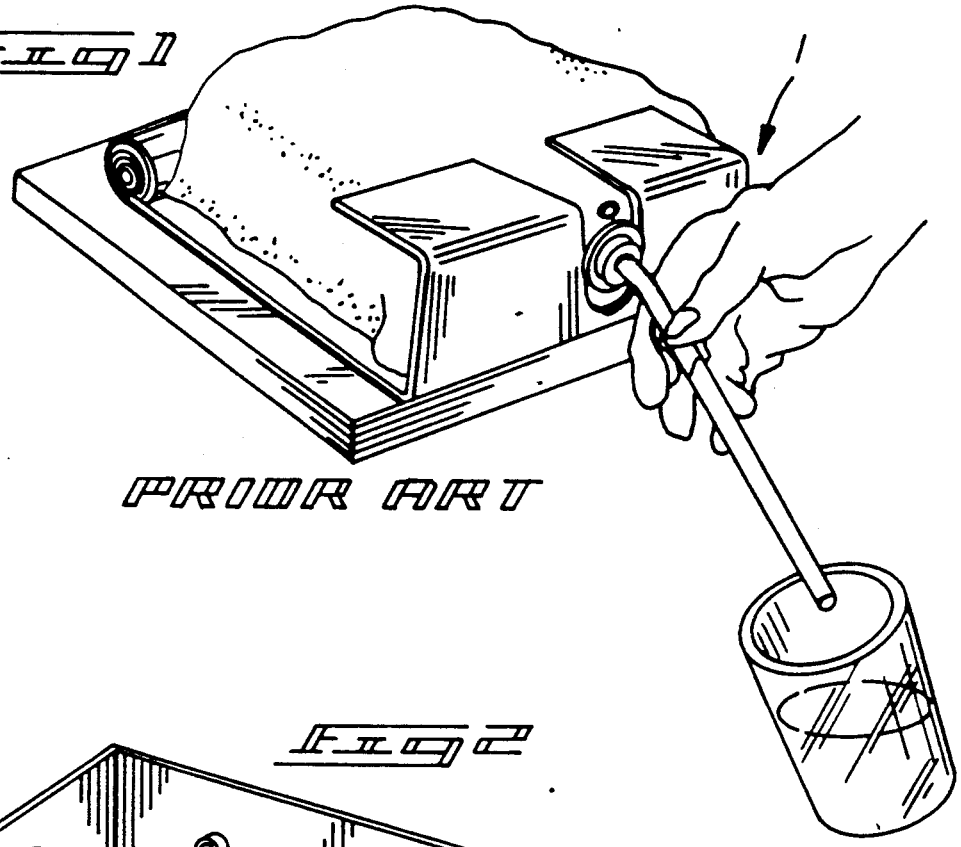
FIG. 1 is an isometric illustration of a prior art dispensing apparatus.
Figure 2:
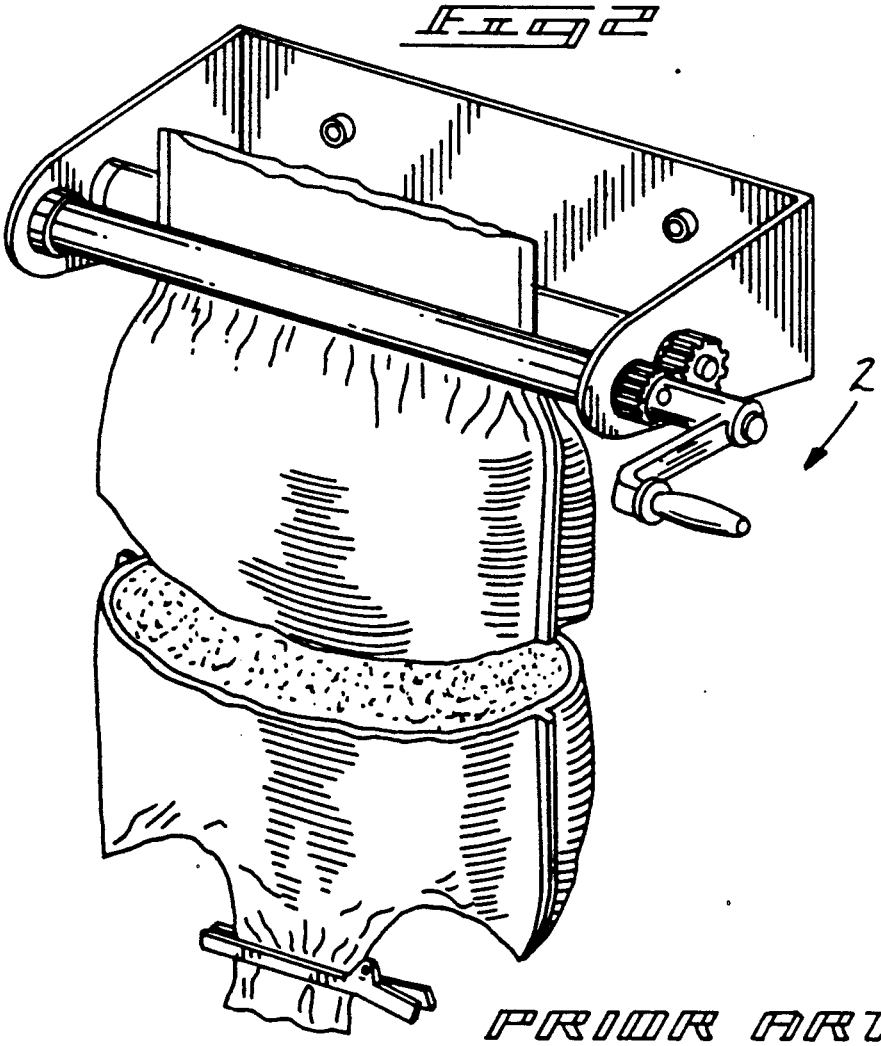
PRIOR ART Fig 2
FIG. 2 is an isometric illustration of a further example of a prior art dispensing apparatus.
Figure 3:
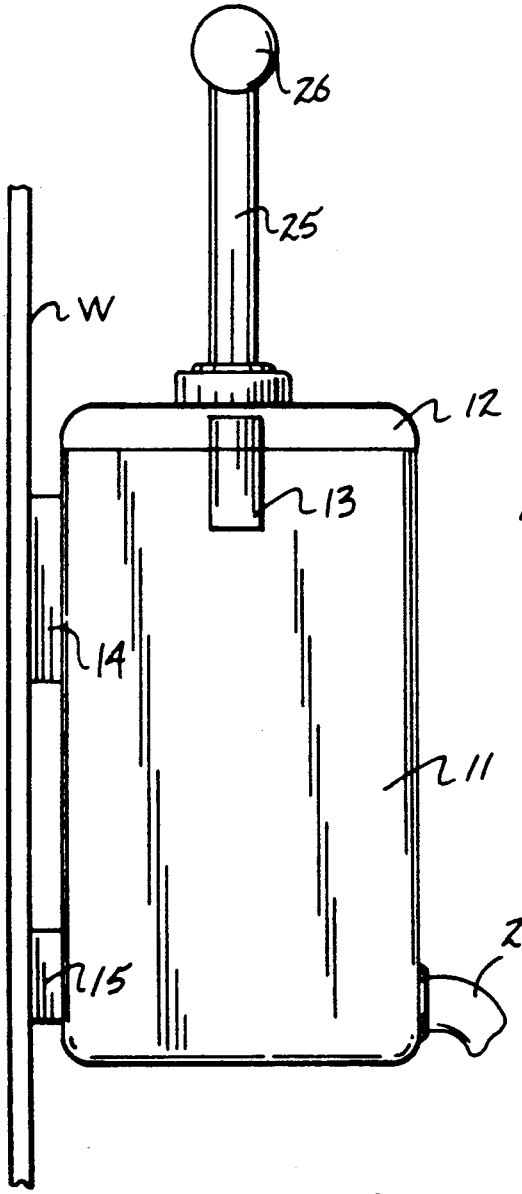
FIG. 3 is an orthographic side view of the instant invention.
Figure 4:
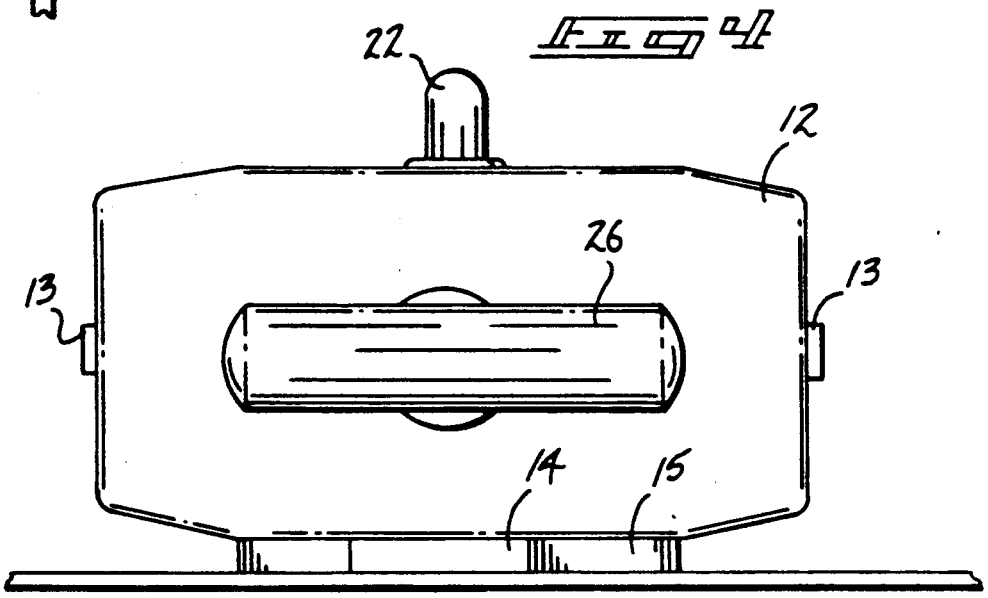
FIG. 4 is an orthographic top view of the instant invention.
Figure 5:
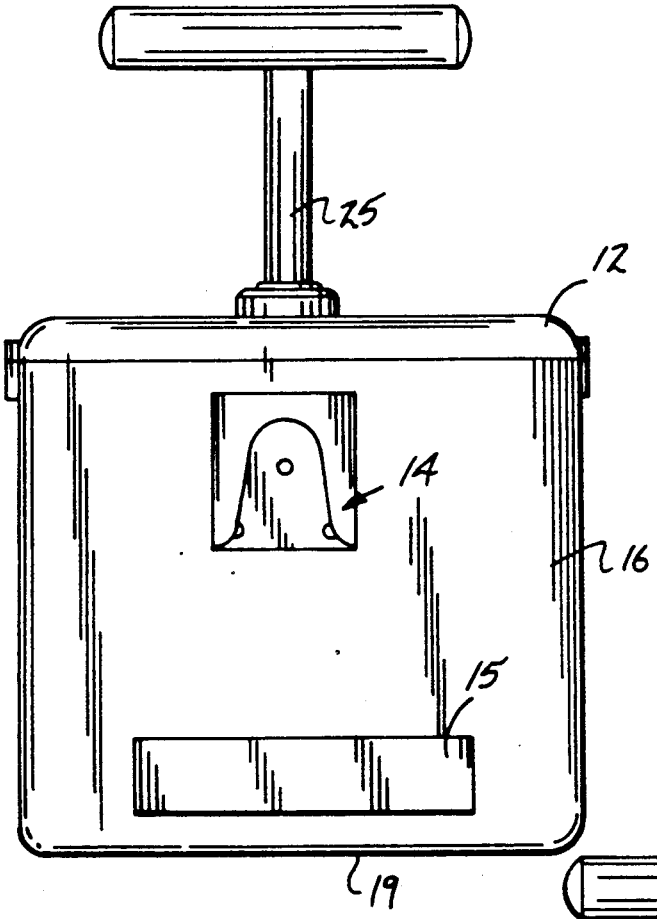
FIG. 5 is an orthographic rear view of the instant invention.
Figure 6:
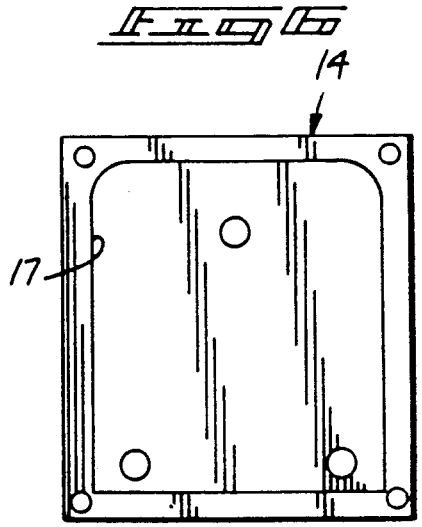
FIG. 6 is an orthographic view, taken in elevation, of a support clip utilized by the instant invention.
Figure 7:
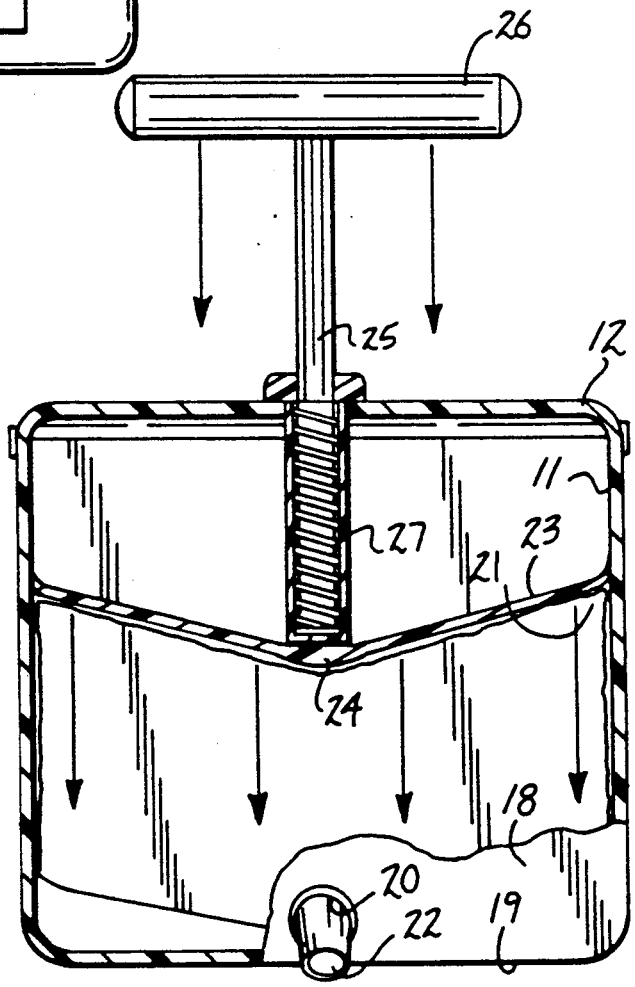
FIG. 7 is an orthographic cross-sectional illustration of the instant invention.
Figure 9:
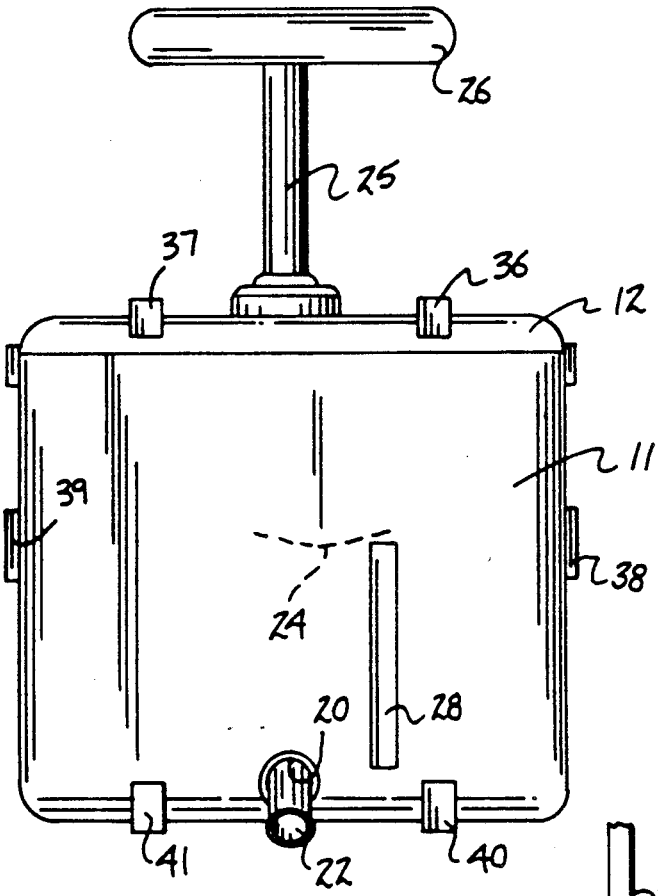
FIG. 9 is an orthographic front view, taken in elevation, utilizing the modified support bracketry.

With reference now to the drawings, and in particular to FIGS. 1 to 11 thereof, a new and improved pump dispensing apparatus embodying the principles and concepts of the present invention and generally designated by the reference numeral 10 will be described.

FIG. 1 illustrates a prior art dispensing organization 1, wherein the flexible container utilizes a coil spring mounting to effect expressing and pressurizing of contents within the container to permit directing of fluid therefrom, as set forth in U.S. Pat. No. 4,765,512. Similarly, the prior art dispensing apparatus 2 as set forth in FIG. 2 and as described in U.S. Pat. No. 4,627,551 utilizes spaced rollers securing a rear end portion of a bag therewithin to effect pressurizing of contents within the bag.

More specifically, the pump dispensing apparatus 10 of the instant invention essentially comprises a lower rigid housing container 11, including a lid 12 mounted overlying the housing and selectively removable therefrom, including a plurality of spaced clamps 13 mounted to side walls of the container 11 to secure opposed side wall portions of the lid 12, as illustrated. A central mount 14 that includes a "U" shaped slot 17 is mounted to a container rear wall 16, with a polymeric bumper 15 mounted underlying the mount 14 parallel to and adjacent the container bottom wall 19. A container forward wall 18 includes a forward wall opening 20 that receives a nozzle 22 of an associated flexible pouch 21. The flexible pouch 21 in fluid communication with the nozzle 22 is positioned within the lower housing 11 and cooperates with a "V" shaped piston 23 that extends coextensively throughout an upper surface of the housing container 11 overlying the flexible pouch 21 and is defined by an apex 24 that is aligned with the opening 20. A piston rod 25 fixedly mounted medially of the piston 23 is aligned with the opening 20 and the apex 24 and includes a central rod cavity mounting a coil spring 27 that is captured within the piston rod cavity and a bottom surface of the lid 12. The piston rod 25 projects orthogonally through the top surface of the lid 12 and orthogonally mounts a handle 26 at an upper terminal end of the rod 25 to permit manual grasping of the handle and effect rejection of the handle within the housing 11 to pressurize the associated flexible pouch 21 to direct fluid or other contents from the bag through the nozzle 22 and may optionally utilize a valve 30 mounted to the nozzle 20 (see FIG. 8) to meter such flow from the bag. Further, a window 28 is formed through the container forward wall 18 and extends from the opening 20 upwardly orthogonally aligned relative to the container bottom wall 19 extending to the apex 24 of the piston when the piston is in the raised position to provide visual observation of remaining components within the flexible pouch 21.

Figure 8:
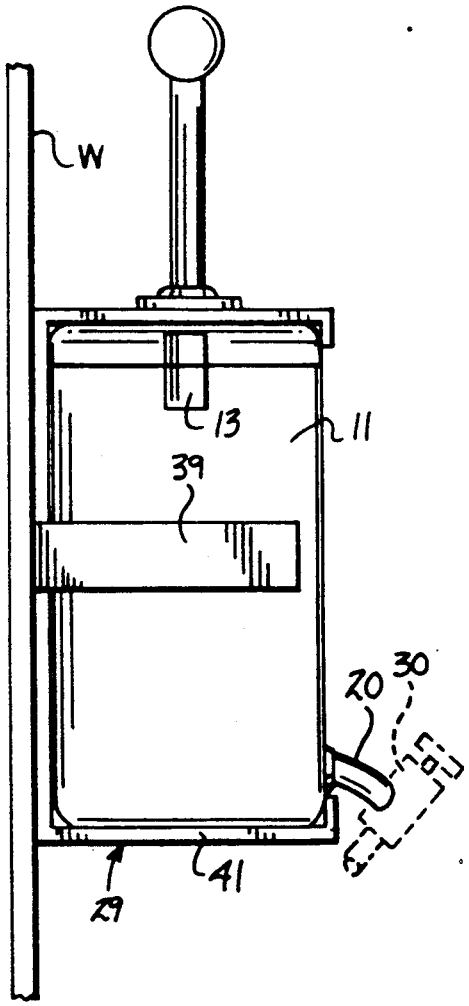
FIG. 8 is an orthographic side view of a modified support bracketry utilized by the instant invention.

A modified support bracket structure 29 is illustrated and utilized in the FIGS. 8–11, including a top brace 31, a middle brace 32, and a bottom brace 33 that are each coextensive and parallel relative to one another in a spaced relationship, wherein the braces each include a respective right and left brace 34 and 35 providing a framework of the top, middle, and bottom braces and the right and left braces, as illustrated in FIG. 10. A right top "L" shaped leg 36 and a left top "L" shaped leg 37 orthogonally project from upper terminal ends of the intersection defined by the right and left braces 34 and 35 and the top brace 31. The right and left top "L" shaped legs 36 and 37 are spaced above and parallel to right and left bottom "L" shaped legs 40 and 41 that are mounted to lower terminal ends of the right and left braces 34 and 35. Right and left medial "L" shaped legs 38 and 39 that extend laterally of the middle brace 32 and are arranged to extend in contiguous communication with the spaced side walls of the housing container 11, wherein the top "L" shaped legs 36 and 37 are mounted to a top surface of the lid 12, while the bottom "L" shaped legs are in continuous communication with the bottom wall 19 to provide rigidity to the organization in its mounting relative to the associated support wall "W", as illustrated in FIG. 8 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pump dispensing apparatus comprising, in combination, a rigid lower housing container, the housing container including a lid removably mounted relative to an upper terminal end of the housing container, and a flexible pouch, the flexible pouch including a nozzle, and the lower housing container including a forward wall, with the forward wall including an opening, with the nozzle projecting through the opening, and the lid including a piston rod reciprocatably mounted through the lid, and a piston mounted within the housing container to a lower terminal end of the piston rod overlying the flexible pouch, wherein the piston is displaced from a first raised position to a second lowered position to effect pressurizing of the flexible pouch within the lower housing container, and wherein the piston is formed of a "V" shaped configuration whose apex is positioned medially of the lower housing container forward wall and aligned with the forward wall opening, and the piston rod including a piston rod cavity, with the piston rod cavity including a coil spring, with the coil spring captured within the piston rod cavity and the bottom surface of the lid to bias the piston rod in the raised position.

2. An apparatus as set forth in claim 1 wherein the piston rod includes a handle mounted to an upper terminal end of the piston rod.

3. An apparatus as set forth in claim 2 including a window directed through the forward wall of the lower housing container, with the window extending from the forward wall opening to the apex of the "V" shaped piston when the "V" shaped piston is in the raised position.

4. An apparatus as set forth in claim 3 wherein the lower housing container and the lid are mounted within a support bracket, and the support bracket arranged for securement to a vertical support wall, and the support bracket including a top brace, a middle brace, and a bottom brace, wherein each brace is coextensive and spaced relative to one another in a parallel relationship, and further including a right brace and a left brace of the respective left and right terminal ends of the top brace, middle brace, and bottom brace, and a plurality of top "L" shaped legs extending orthogonally relative to upper terminal ends of the respective right and left brace in contiguous communication with a top surface of the lid, and a right and left bottom "L" shaped leg mounted to respective lower terminal ends of respective right and left braces in contiguous communication with a bottom wall of the lower housing container, and a respective right and left medial "L" shaped leg mounted medially of the right and left brace in contiguous communication with spaced side walls of the lower housing container.

* * * * *